US011560642B2

(12) United States Patent
Kearns et al.

(10) Patent No.: US 11,560,642 B2
(45) Date of Patent: Jan. 24, 2023

(54) APPARATUS FOR AN INERT ANODE PLATING CELL

(71) Applicant: Lam Research Corporation, Fremont, CA (US)

(72) Inventors: Gregory Kearns, West Linn, OR (US); Bryan L. Buckalew, Tualatin, OR (US); Jacob Kurtis Blickensderfer, Tualatin, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 17/282,583

(22) PCT Filed: Oct. 2, 2019

(86) PCT No.: PCT/US2019/054297
§ 371 (c)(1),
(2) Date: Apr. 2, 2021

(87) PCT Pub. No.: WO2020/072649
PCT Pub. Date: Apr. 9, 2020

(65) Prior Publication Data

US 2021/0340687 A1 Nov. 4, 2021

Related U.S. Application Data

(60) Provisional application No. 62/740,845, filed on Oct. 3, 2018.

(51) Int. Cl.
*C25D 5/08* (2006.01)
*C25D 7/12* (2006.01)
(Continued)

(52) U.S. Cl.
CPC ..... *C25D 17/001* (2013.01); *C25D 5/08* (2013.01); *C25D 7/12* (2013.01); *C25D 17/004* (2013.01); *C25D 17/06* (2013.01); *C25D 17/12* (2013.01)

(58) Field of Classification Search
CPC ..... C25D 7/12–123; C25D 17/001; H01L 21/76873; H05K 3/188
See application file for complete search history.

(56) References Cited

U.S. PATENT DOCUMENTS 9,765,443 B2 9/2017 Wilson et al.
2003/0178297 A1* 9/2003 Peace ..... C25D 17/008 204/224 R
(Continued)

FOREIGN PATENT DOCUMENTS

CN 112805415 5/2021
JP S62-158838 U * 10/1987
(Continued)

OTHER PUBLICATIONS

International Application Serial No. PCT/US2019/054297, International Search Report dated Jan. 17, 2020, 3 pgs.
(Continued)

*Primary Examiner* — Ho-Sung Chung
(74) *Attorney, Agent, or Firm* — Schwegman Lundberg & Woessner, P.A.

(57) ABSTRACT

In one example, an electroplating apparatus is provided for electroplating a wafer. The electroplating apparatus comprises a wafer holder for holding a wafer during an electroplating operation and a plating cell configured to contain an electrolyte during the electroplating operation. An anode chamber is disposed within the plating cell, and a charge plate is disposed within the anode chamber. An anode is positioned above the charge plate within the anode chamber.
(Continued)

In some examples, the anode chamber is a membrane-less anode chamber.

9 Claims, 11 Drawing Sheets

(51) Int. Cl.
*C25D 17/06* (2006.01)
*C25D 17/12* (2006.01)
*C25D 17/00* (2006.01)

(56) References Cited

U.S. PATENT DOCUMENTS

2007/0158668 A1* 7/2007 Tarsa ..... C25D 15/00 257/98
2008/0029398 A1* 2/2008 Yamamoto ..... C25D 17/12 205/80
2012/0000786 A1* 1/2012 Mayer ..... C25D 17/02 205/143
2012/0152750 A1 6/2012 Arvin et al.
2013/0334052 A1* 12/2013 Chua ..... C25D 3/60 205/99
2014/0262796 A1* 9/2014 Chen ..... C25D 17/10 205/89
2015/0122658 A1 5/2015 Kim et al.
2015/0211144 A1 7/2015 Feng et al.

FOREIGN PATENT DOCUMENTS

WO WO-2016027158 A1 2/2016
WO WO-2017021489 A1 * 2/2017 ..... C25D 17/005

OTHER PUBLICATIONS

International Application Serial No. PCT/US2019/054297, Written Opinion dated Jan. 17, 2020, 8 pgs.
"International Application Serial No. PCT US2019 054297, International Preliminary Report on Patentability dated Apr. 15, 2021", 11 pages.

* cited by examiner

APPARATUS FOR AN INERT ANODE PLATING CELL

CLAIM OF PRIORITY

This patent application is a U.S. National Stage Filing under 35 U.S.C. 371 from International Application No. PCT/US2019/054297, filed on 2 Oct. 2019, and published as WO 2020/072649 A1 on 9 Apr. 2020, which claims priority to U.S. Provisional Application Ser. No. 62/740,845, entitled, "FLOW DISTRIBUTION APPARATUS FOR AN INERT ANODE PLATING CELL," filed 3 Oct. 2018; the disclosure of each of which is incorporated herein by reference in its entirety.

FIELD

The present disclosure relates generally to electroplating (plating) systems and methods for semiconductor manufacturing. In particular, the disclosure relates to methods and apparatus for electroplating one or more materials onto a substrate. In many cases the material is a metal and the substrate is a semiconductor wafer, although the disclosed embodiments are not so limited.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Electrochemical deposition processes are well-established in modern integrated circuit fabrication. The transition from aluminum to copper metal line interconnections in the early years of the twenty-first century drove a need for increasingly sophisticated electrodeposition processes and plating tools. Much of the sophistication evolved in response to the need for ever smaller current carrying lines in device metallization layers. These copper lines are formed by electroplating the metal into very thin, high-aspect ratio trenches and vias in a methodology commonly referred to as "damascene processing" (pre-passivation metalization).

Electrochemical deposition is now poised to fill a commercial need for sophisticated packaging and multichip interconnection technologies known generally and colloquially as wafer level packaging (WLP) and through silicon via (TSV) electrical connection technology. These technologies present their own very significant challenges due in part to the generally larger feature sizes (compared to Front End of Line (FEOL) interconnects) and high aspect ratios.

Depending on the type and application of the packaging features (e.g., through chip connecting TSV, interconnection redistribution wiring, or chip to board or chip bonding, Such as flip-chip pillars), plated features are usually, in current technology, greater than about 2 micrometers and are typically about 5-100 micrometers in their principal dimension (for example, copper pillars may be about 50 micrometers). For some on-chip structures such as power busses, the feature to be plated may be larger than 100 micrometers. The aspect ratios of the WLP features are typically about 1:1 (height to width) or lower, though they can range as high as perhaps about 2:1 or so, while TSV structures can have very high aspect ratios (e.g., in the neighborhood of about 20:1).

SUMMARY

The disclosed embodiments relate to methods and apparatus for controlling electrolyte hydrodynamics during electroplating. More particularly, methods and apparatus described herein are particularly useful for plating metals onto semiconductor wafer substrates, such as through resist plating of small micro-bumping features having widths less than, e.g., about 50 um, and gold through silicon via (TSV) features.

In some examples, an electroplating apparatus for electroplating a wafer comprises a wafer holder for holding a wafer during an electroplating operation; a plating cell configured to contain an electrolyte during the electroplating operation; an anode chamber disposed within the plating cell; a charge plate disposed within the anode chamber; and an anode positioned above the charge plate within the anode chamber.

In some examples, the anode chamber is a membrane-less anode chamber. In some examples, the electroplating apparatus further comprises a flow-shaping plate or CIRP positioned between a wafer held in the wafer holder and the anode during the electroplating operation. In some examples, a portion of the charge plate is sealed to a wall of the plating cell. In some examples, the anode is a composite anode and includes a plurality of anode layers. In some examples, each layer of the plurality of anode layers is displaced with respect to one another to define open or varied pores of a mesh structure for the anode.

In some examples, the anode is supported above the charge plate by a plurality of standoff pins. In some examples, a height of the plurality of standoff pins defines a gap between the anode and the charge plate, wherein the height is in the range 0.39 to 0.59 inches. In some examples, the charge plate includes a plurality of holes formed therein, with each hole having a diameter in the range 0.03 to 0.05 inches and being distributed in a grid pattern having a grid spacing in the range 0.4 to 0.7 inches.

DESCRIPTION OF THE DRAWINGS

Some embodiments are illustrated by way of example and not limitation in the views of the accompanying drawings.

DESCRIPTION

Figure 1:
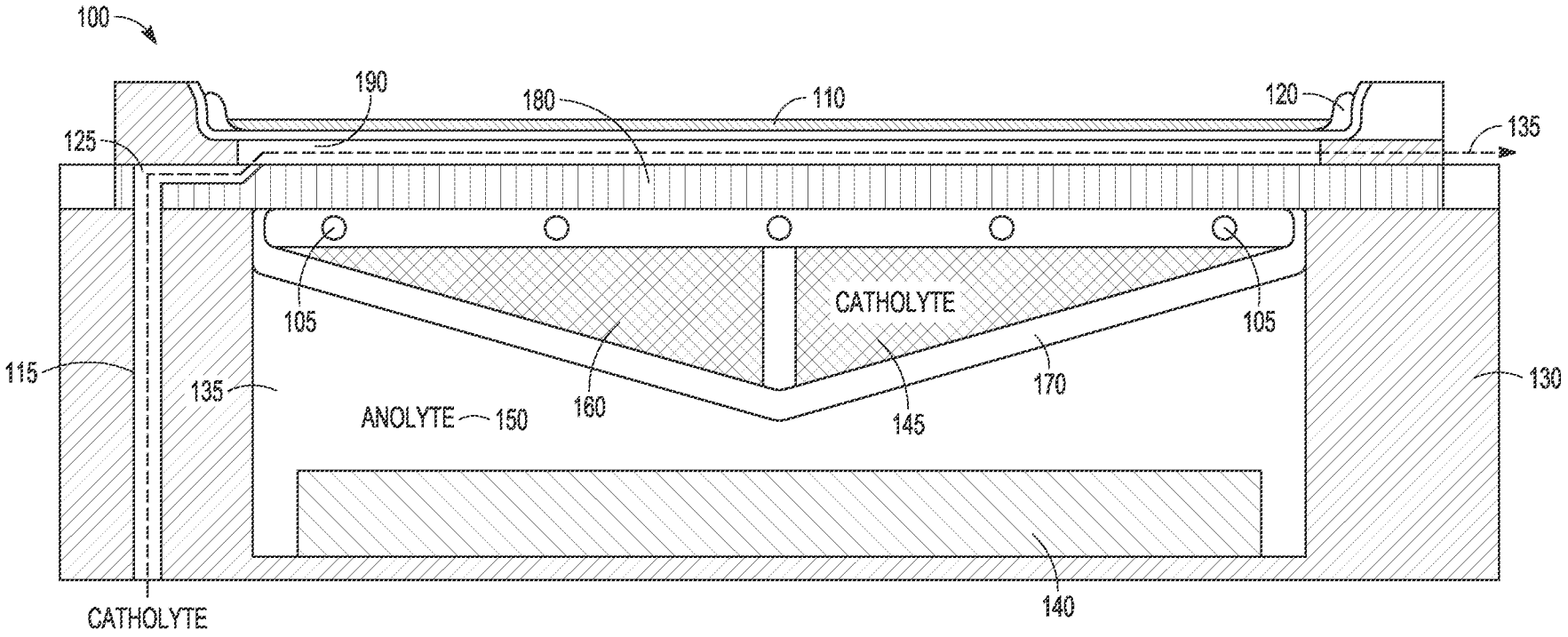
FIG. 1 shows a sectional view of a plating apparatus, according to an example embodiment.

The description that follows includes systems, methods, techniques, instruction sequences, and computing machine program products that embody illustrative embodiments of the present invention. In the following description, for purposes of explanation, numerous specific details are set forth in order to provide a thorough understanding of example embodiments. It will be evident, however, to one skilled in the art, that the present embodiments may be practiced without these specific details.

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to any data as described below and in the drawings that form a part of this document: Copyright LAM Research Corporation, 2018, All Rights Reserved.

By way of general background, semiconductors usually start as a wafer-thin slice of a purified semiconductor material. Usually these wafers are produced by heating the material, molding it, and processing it to cut and grind it into small, smooth wafers. In a deposition phase, the prepared wafers are cleaned, heated, and exposed to pure oxygen within a diffusion furnace. This results in a reaction that produces a uniform film of silicon dioxide on the surface of the wafer. In a masking phase (also called photolithography or photo-masking), this process protects one area of the wafer while another is worked on. After applying a light-sensitive film to one part of the wafer, an intense light is then projected through a mask onto it, exposing the film with the mask pattern. In an etching phase, manufacturers bake the wafer to harden the remaining film pattern, and then expose it to a chemical solution to eat away the areas not covered by the hardened film. After this step, the film is removed, and the wafer inspected to ensure proper image transfer.

In a doping phase, atoms with one less or one more electron than the material are introduced into the exposed wafer area to alter the electrical properties of the silicon. For silicon, these are boron and phosphorous, respectively. Adding atoms with one more electron is termed "N-type doping" because it adds a free electron to the silicon lattice, giving the material a negative charge. Adding atoms with one less electron is termed "P-type doping" because the added atoms create holes in the silicon lattice where a silicon electron has nothing to which it can bond. This creates a positive charge. Both doping types turn the semiconductor into an excellent conductor. The manufacturer then repeats these steps, deposition through doping, several times until the last layer is completed and all active circuits are formed.

Of more relevance to the present application is a dielectric deposition and plating phase. Following the conclusion of the internal parts of the semiconductor, the manufacturer connects the devices by adding layers of metals and insulators. This both protects these circuits and creates a connection between the inner workings of the semiconductor and the outside world. A final insulating layer is added to protect the circuit from damage and contamination. Openings are etched into the film to allow access to the top metal plate. Plating is one of the last steps in the semiconductor manufacturing process but holds an important role as a protective shell and interactive layer between the semiconductor's internal circuits and the outside world.

Manufacturers often plate semiconductors using a process called electroplating. Also known as electrodeposition, this process deposits a thin layer of metal on the surface of a work piece referred to as the substrate. The plating metal is connected to the positively charged electrode of an electrical circuit. This electrode is called the anode. The work piece, or substrate, is placed at the negatively charged electrode, called the cathode. Both the plating metal and the substrate are immersed in an electrolytic solution called a bath. After submersion, a DC current is supplied to the anode, oxidizing the atoms of the plating metal and dissolving them into the bath. At the cathode, the negative charge reduces the atoms, causing them to plate the substrate.

In the case of gold electroplating, the plating metal is not used as an anode. An inert anode is used where oxygen generation (or in the case of sulphite containing baths sulphite oxidation) completes the electrical circuit. Gold ions are provided as a soluble component of the plating bath and are regenerated by dosing gold ions to the bath. In the case of gold electroplating, direct current or pulsed currents can be used.

Current semiconductor electroplating is much smaller in scale than the average electroplating processes. The chips in question are often less than an inch in diameter, and the circuits inside them may consist of miniscule wires or formations mere nanometers in size. Any errors, such as breakage or the addition of dust particles to the semiconductor, can result in a defective product. As a result, semiconductor electroplating involves many extra precautions and considerations in order to ensure the quality of the finished product.

As mentioned above, the inventors have identified instability of Au plating baths related to reduction of bath components at the cathode (wafer surface) during plating. The build-up of these reduced species in the plating bath can be extremely costly as they result in wafer defects, impacting wafer yield and bath lifetime. Specifically, high cost Au plating baths are susceptible to this degradation. In some present embodiments, bath degradation products that are generated are re-oxidized to a stable state at the anode when high or frequent exposure of the electroplating bath is provided. The result may include the substantial elimination of wafer defects and an extended bath lifetime. Some embodiments provide improved irrigation over the anode to improve wafer yield and bath life by eliminating separation of the anode and cathode chambers and forcing all flow over the anode. Specific embodiments in this regard are described further below.

Some conventional arrangements for inert anode plating employ a membrane disposed between an anode and a wafer to prevent oxygen bubbles generated at the anode from reaching the wafer. The anode chamber is not truly separated from the catholyte as both return to and mix in the bath. The cell flow splits between the anode chamber and the plating cell, with the majority of the flow going to the plating cell to maximize shear flow at the wafer for plating uniformity. Therefore, the bath solution turnover in the anode chamber is very low. The low anode chamber turnover results in limited oxidation/regeneration of degraded components that are generated at the wafer surface.

In some present embodiments, all bath flow is forced through the anodes before going to the wafer. More specifically, in one embodiment, a conventional bath membrane is removed, and a standard cell inlet and anode chamber outlet are eliminated such that all bath flow runs through the anode and directly to the wafer. Since sulphite based Au baths do not generate oxygen bubbles (sulphite is oxidized directly to sulphate at the anode as opposed to $O_2$ generation from $H_2O$) a membrane is unnecessary. The bath solution flows through the anode and to a wafer crossflow region. In some examples described herein, a reconfigured inlet manifold and anode are provided to maximize irrigation while the anode area is increased at least three times to maximize anode exposure. Another embodiment includes an anode disposed closer to the wafer and uses a cell crossflow to irrigate the anode and eliminate a conventional cell inlet and outlet.

FIG. 1 depicts a cross-section of general components of a plating apparatus 100 for plating metal onto a wafer 110, which is held in position by a wafer cup 120. Apparatus 100 includes a plating cell 130, which is a dual-chamber cell, having an anode chamber 135 including a metal (for example, copper Cu or gold Au) anode 140 and anolyte 150. In some examples of Au electroplating, a metal anode is not used. Instead, the anode 140 includes an inert mesh anode (for example titanium Ti coated with platinum Pt or iridium oxide IrOx) employed as a catalytic site for direct oxidation of the electrolyte. In some examples, the anode 140 oxidizes local $H_2O$ to $O_2$+H+ but in the case of sulphite based Au baths, the anode 140 catalyzes oxidation of sulphite to sulphate. In some examples, the anode 140 includes a mesh wire 'plate'.

The anode 140 may be disposed on the floor of the anode chamber 135 as shown or suspended in the form of a plate in the anolyte 150. In some examples, the anode chamber 135 and a cathode chamber 145 are in fluid communication with each other but separated regionally by a membrane 160 which may be supported by a support member or membrane frame 170. In the case of gold plating systems or other hardware employing an inert anode, the membrane is not an ionic membrane. It is a porous membrane with no ion selectivity and merely acts as a structural element to block bubbles and restrict flow.

The plating apparatus 100 includes a flow-shaping plate 180. The flow-shaping plate 180 may also be referred to as a "channeled ionically resistive plate" (CIRP) 180 or a "channeled ionically resistive element". The CIRP 180 is positioned between the working electrode (i.e., the wafer 110 or substrate) and the counter electrode (i.e., the anode 140) during plating in order to shape the electric field and control electrolyte (anolyte and catholyte) flow characteristics.

A flow diverter 190 is provided on top of the CIRP 180 and aides in creating transverse shear flow. Catholyte is introduced into the cathode chamber 145 (above the membrane 160) via flow ports 105. These flow ports 105 may be provided at various elevations within the plating apparatus 100. From the flow ports 105, catholyte passes upwardly through the CIRP 180 and produces impinging flow onto the underside plating surface of the wafer 110. In addition to catholyte flow ports 105, an additional flow port 115 introduces catholyte at its exit at a position 125 distal to the vent or gap 135 of the flow diverter 190. In this example, the exit of the flow port 115 is formed as a channel in the CIRP 180. One functional result is that catholyte flow is introduced directly into the pseudo chamber formed between the CIRP 180 and the wafer plating surface in order to enhance transverse flow across the wafer surface and thereby normalize flow vectors across the wafer 110 (and the CIRP 180).

Figure 2:
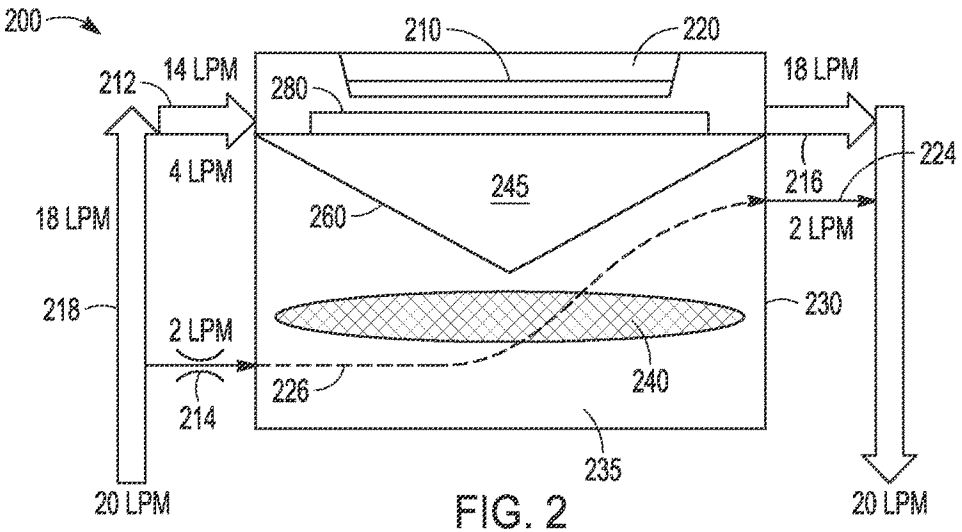
FIG. 2 (PRIOR ART)
FIG. 2 shows a schematic sectional view of a conventional plating apparatus, according to an example embodiment.

FIG. 2 depicts a cross-section of general components of a conventional plating apparatus 200 for plating Au onto a wafer 210 held in position by a wafer cup 220. Apparatus 200 includes a plating cell 230, which is a dual-chamber cell, having an anode chamber 235 including a mesh inert anode 240 and anolyte. The anode chamber 235 and a cathode chamber 245 are in fluid communication but separated regionally by a membrane 260. The plating apparatus 200 includes a CIRP 280 positioned between the working electrode (i.e., the wafer 210) and the counter electrode (i.e., the anode 240) during plating in order to shape the electric field and control electrolyte (anolyte and catholyte) flow characteristics.

The plating apparatus 200 has a wafer flow inlet 212 and an anode chamber inlet 214. The plating apparatus 200 also includes a wafer flow outlet 216 and an anode chamber outlet 224. The incoming electrolyte flow 218 is split between the anode chamber inlet 214 (2 lpm) and the wafer flow inlet 212 (14 lpm upper flow, 4 lpm lower flow), i.e. with the majority of the electrolyte flow 218 ultimately going to the wafer 210. Flow through the anode chamber 235 from inlet 214 is shown by the dotted arrow 226. Example flow rates of electrolyte through the inlets 212 and 214 and to the outlets 216 and 224 are as shown in the view expressed in liters per minute (lpm).

Figure 3B:
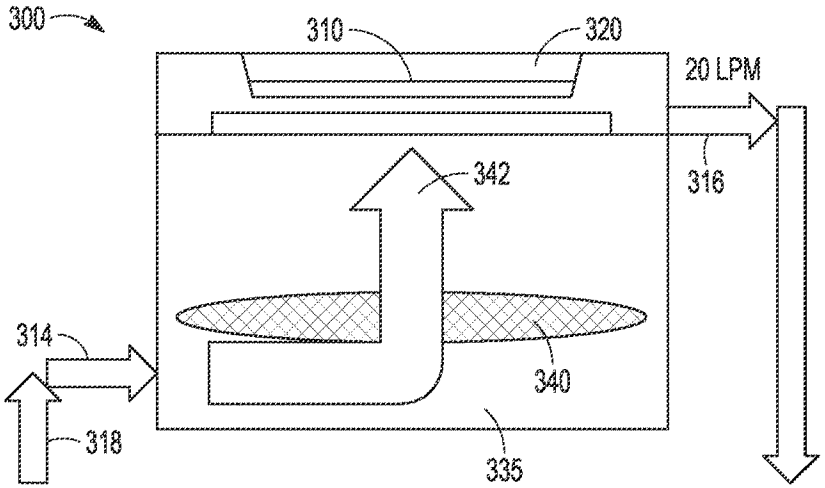
FIGS. 3A and 3B show schematic sectional views of a plating apparatus, according to example embodiments.
Figure 3A:
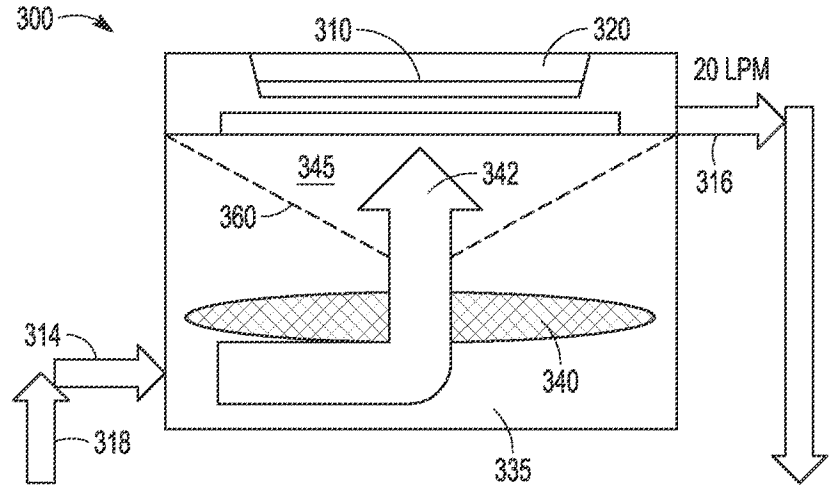

In some present embodiments, such as those shown in cross-sectional view in FIGS. 3A-3B, the inlets 212 and 214, and the outlets 216 and 224, have been removed or modified. Components that are similar to those shown in FIG. 2 are labelled accordingly. As shown in FIG. 3A, all of the electrolyte flow 318 (20 lpm) enters the anode chamber 335, passes through an inert anode 340, and then flows upwardly at 342 to the wafer 310. As exemplified in FIG. 3B, the absence of a membrane 365 (shown in FIG. 3A but not in FIG. 3B) presents no barrier and this has no effect on the flow 342. In some examples, and if it is provided, a membrane 360 may include a polypropylene mesh. The membrane 360 material may include a woven or nonwoven fabric having 120 μm open pores. The membrane material is selected to offer very little, if any, fluidic flow resistance.

Figure 4:
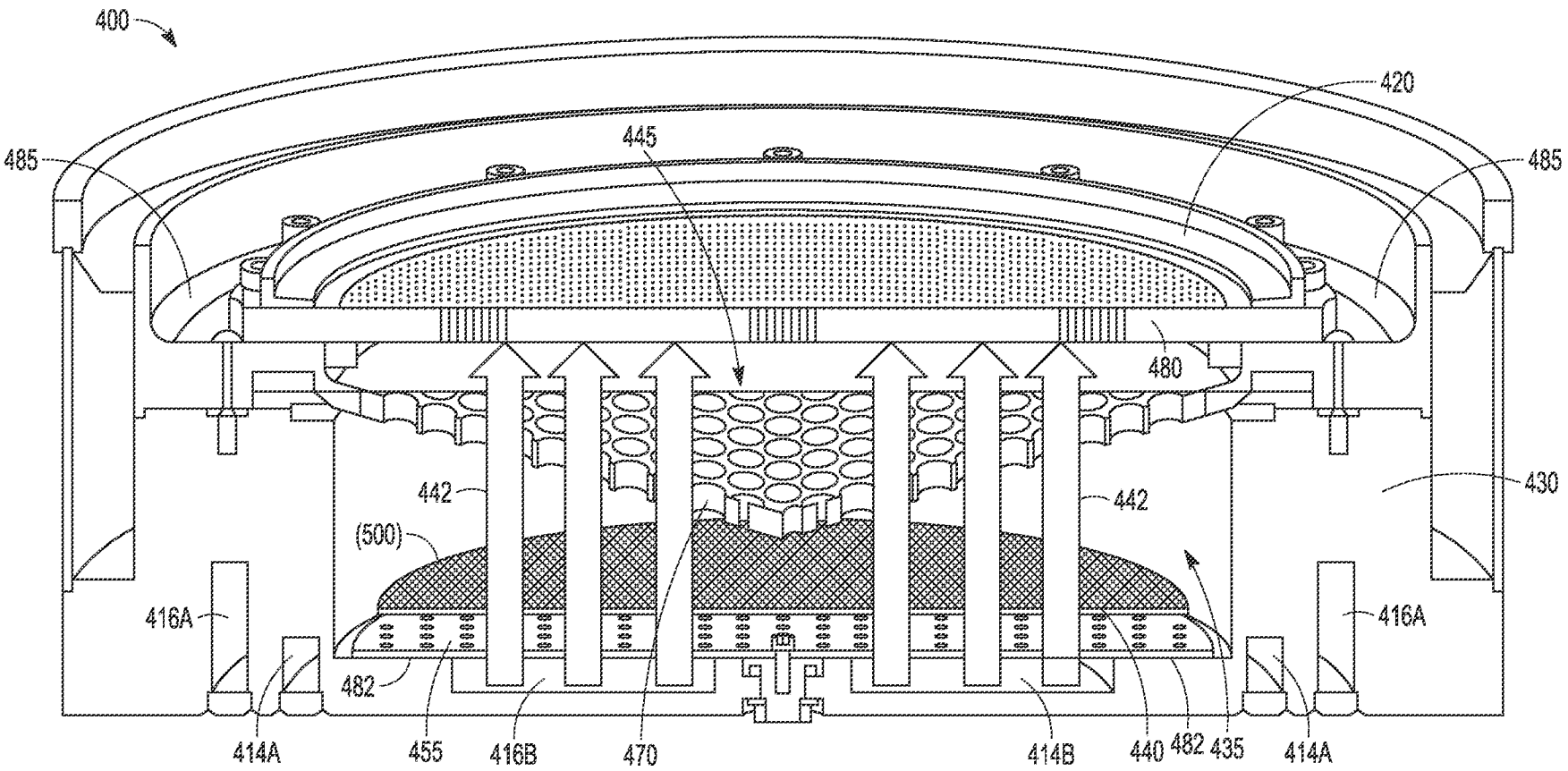
FIG. 4 shows a sectional view of a plating apparatus, according to an example embodiment.

FIG. 4 depicts a cross-section of general components of another example of a plating apparatus 400 of the present disclosure. This example can plate Au onto a wafer (not shown). The apparatus 400 includes a a topside insert 420 for a CIRP 480. The insert 420 may seal flow to some extent when a cup (holding a wafer) is lowered into place during a plating operation. The apparatus 400 includes a plating cell 430, which is a dual-chamber cell having an anode chamber 435, which includes a meshed inert anode 440 positioned above and fixed to an apertured charge plate 455 by standoff pins 500 (shown in more detail in FIG. 5).

The anode chamber 435 also includes an anolyte. In some examples, the anode chamber 435 and a cathode chamber 445 are in fluid communication with each other but may be regionally separated by a filter or a mesh (not shown) which may be supported in use by a downwardly cone-shaped membrane frame 470. The filter or mesh allows fluid to flow but may filter certain particles. In some embodiments, a membrane and membrane frame 470 are not provided (for example as shown in FIG. 3B described above).

The plating apparatus 400 includes a flow shaping plate or CIRP 480. The CIRP 480 is positioned between the working electrode and the counter electrode (i.e., the anode 440) during plating in order to shape the electric field and control electrolyte (anolyte and catholyte) flow characteristics. A walled ring 485 may be provided in association with the CIRP 480 which allows electrolyte solution to flow over the wall of the ring in operation so that the solution level is maintained at that height.

Electrolyte enters the plating apparatus 400 via the inlets 414A and 416A, which are in fluid communication with the conduits marked 414B and 416B and flows upwardly in the direction of arrows 442 toward the wafer through the apertures in the charge plate 455 and the meshed anode 440. The conduits 414B and 416B may be integrally formed as a circular path underneath the charge plate 455.

The absence of a membrane and membrane frame 470 can maximize the flow 442 from the anode 440 to the wafer. The charge plate 455 may be sealed to the dual chamber cell around its outer periphery at 482 to promote a full and even flow of electrolyte to the anode 440 from the conduits 414B and 416B. Electrolyte flow cannot escape around the edges of the charge plate 455. The anode standoff pins 500 allow flow to converge within the space between the charge plate 455 and anode 440 and enhance anode irrigation.

Figure 5:
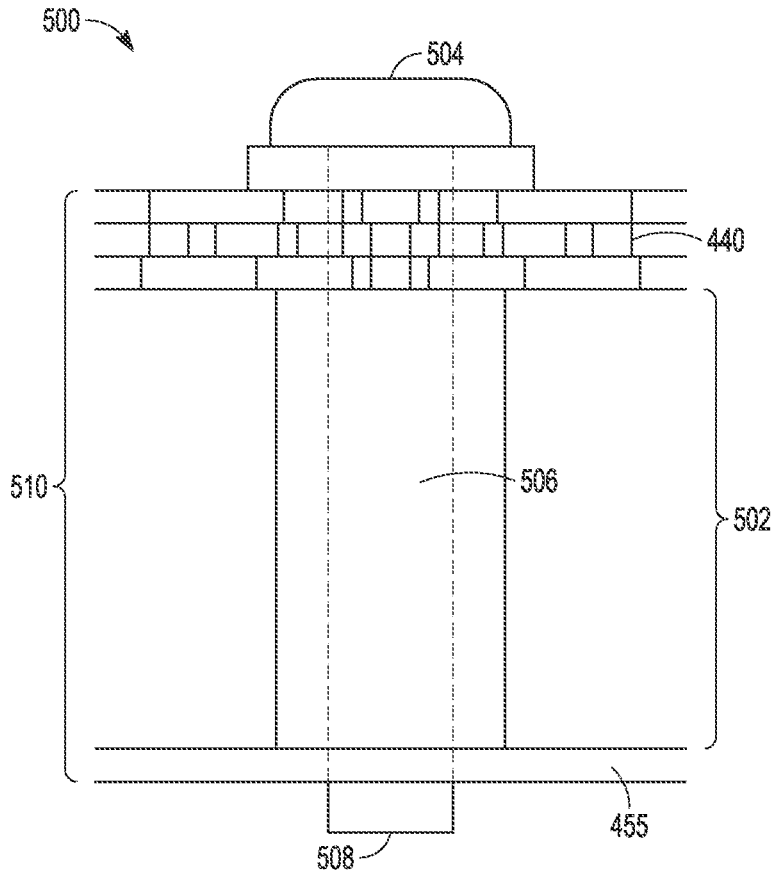
FIG. 5 shows a sectional view of a standoff pin, according to an example embodiment.

With reference to FIG. 5, a standoff pin 500 includes a head 504, a stem 506, and a foot 508. The stem 506 passes through an appropriately sized hole in the anode 440 while the foot 508 is retained in an appropriately sized hole in the charge plate 455. A length or "rise" 510 of a standoff pin 500 can play a significant role in enhancing even flow distribution within a plating apparatus 400. The rise 510 of a standoff pin 500 can be designed or adjusted to regulate an anode-to-plate distance 502 between an anode 440 and a charge plate 455 over which the anode 440 is supported by the standoff pin 500. Depending on a charge plate geometry, a height of the plurality of standoff pins defines a gap between the anode and the charge plate, wherein the height is in the range 0.39 to 0.59 inches.

Figure 6:
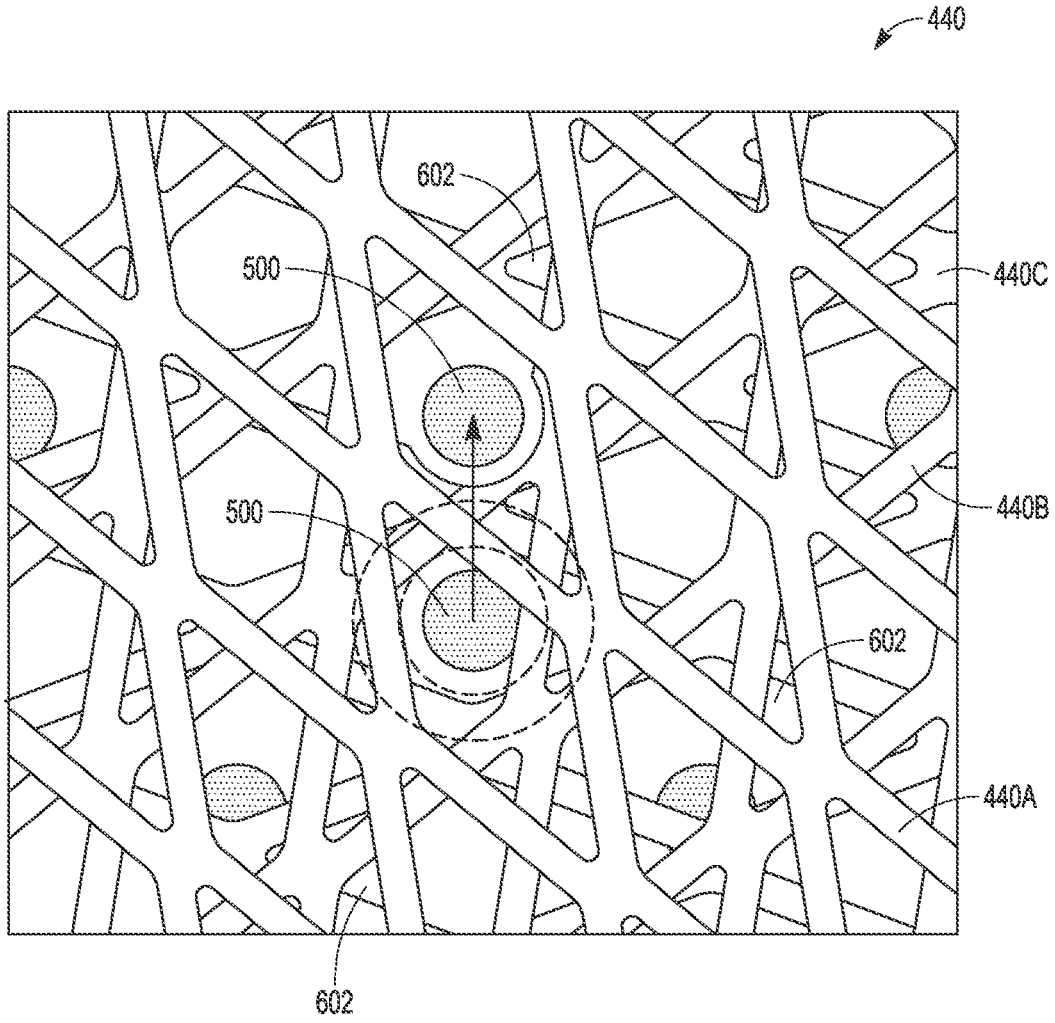
FIG. 6 shows a top view of an anode, according to an example embodiment.

With reference to FIG. 6, in some examples of a plating apparatus, an example anode 440 may include a composite anode comprising layers, with each layer having the same or different anode qualities in some examples. For example, as shown in FIG. 6, three inert anode layers 440A, 440B, and 440C overlie each other to form a composite anode having, for example, a cross section as shown in FIG. 5. Each layer is slightly displaced with respect to another one so as to define open pores 602 or varying shape in a multi-layer meshed structure of the anode 440. The pores 602 may allow enhanced passage of electrolyte therethrough. The top of a standoff pin 500 is visible in the view and, in this instance, the location of the standoff pin 500 has been moved to an open pore 602 large enough to accommodate it.

In testing, exposed surfaces of an anode 440 such as a composite anode increased anode exposure by a factor of up to three in some examples. In some examples, irrigation of the anode 440 by the flow (arrow 442, FIG. 4) increased by a factor of up to twenty. The increase in anode exposure, coupled with the increase in irrigation flow therethrough, improved plating formation by a factor of up to sixty times in some examples.

Figure 7:
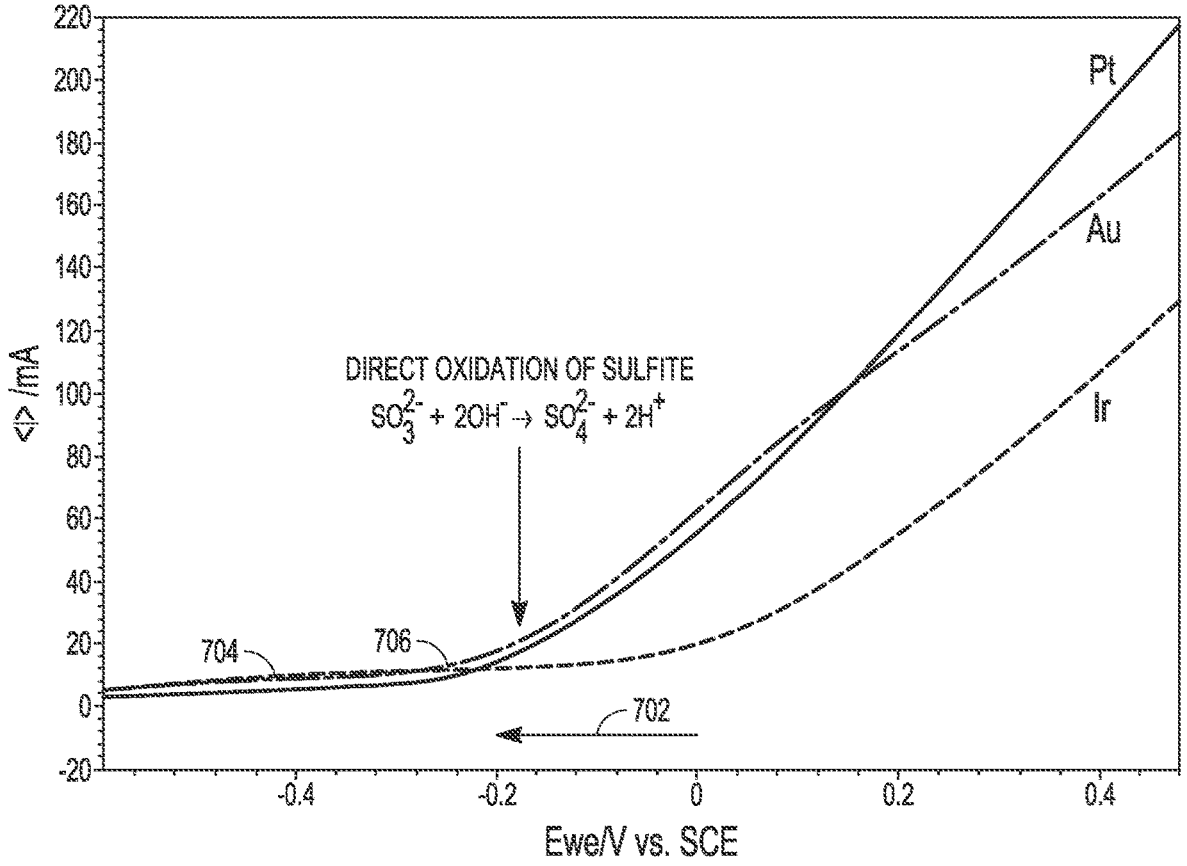
FIG. 7 shows a graph of test results of certain example embodiments.
Figure 8A:
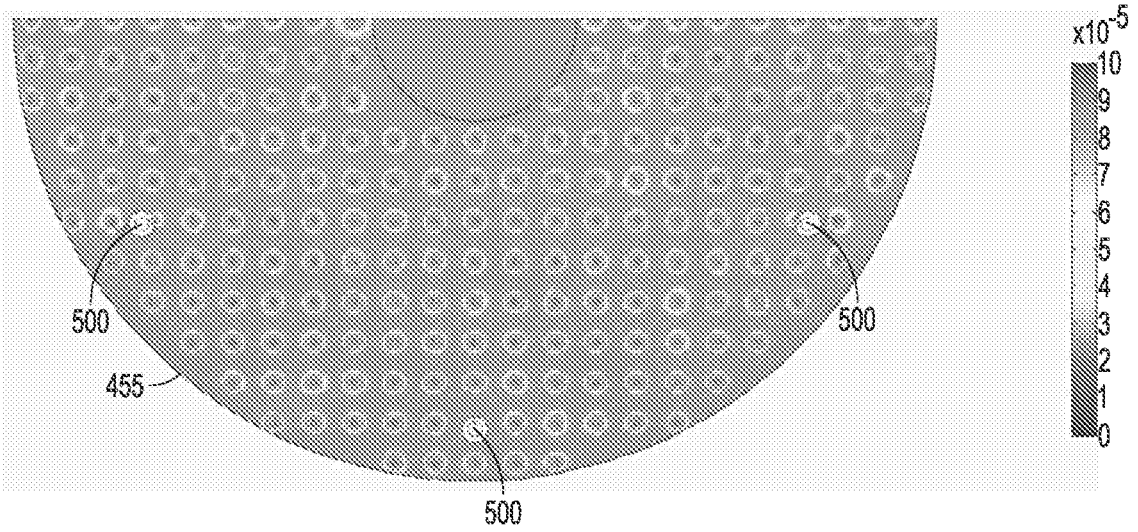
FIGS. 8A-8D show charge plate distribution patterns, according to examples embodiments.
Figure 8B:
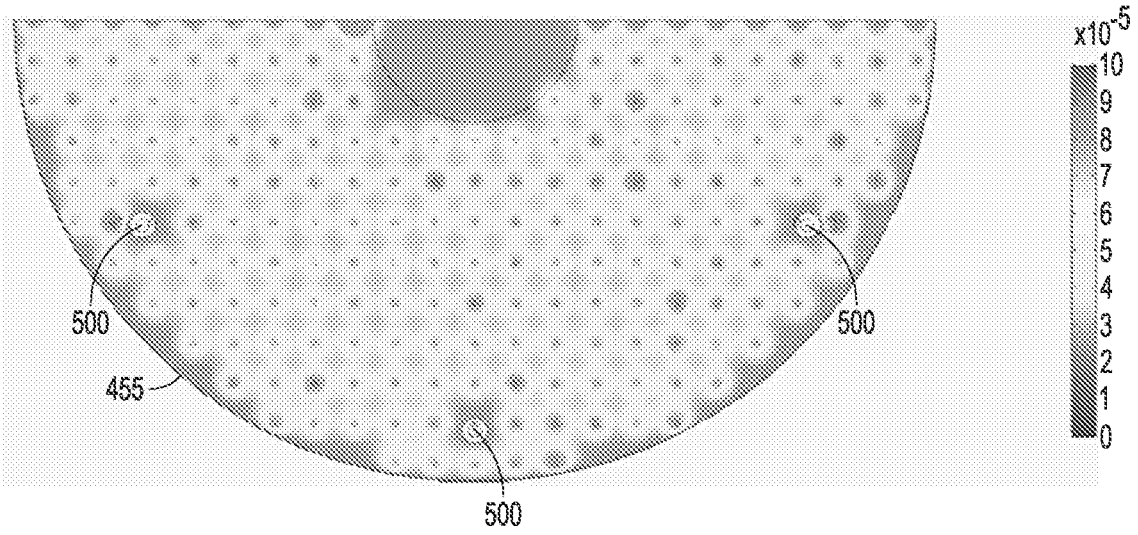
Figure 8C:
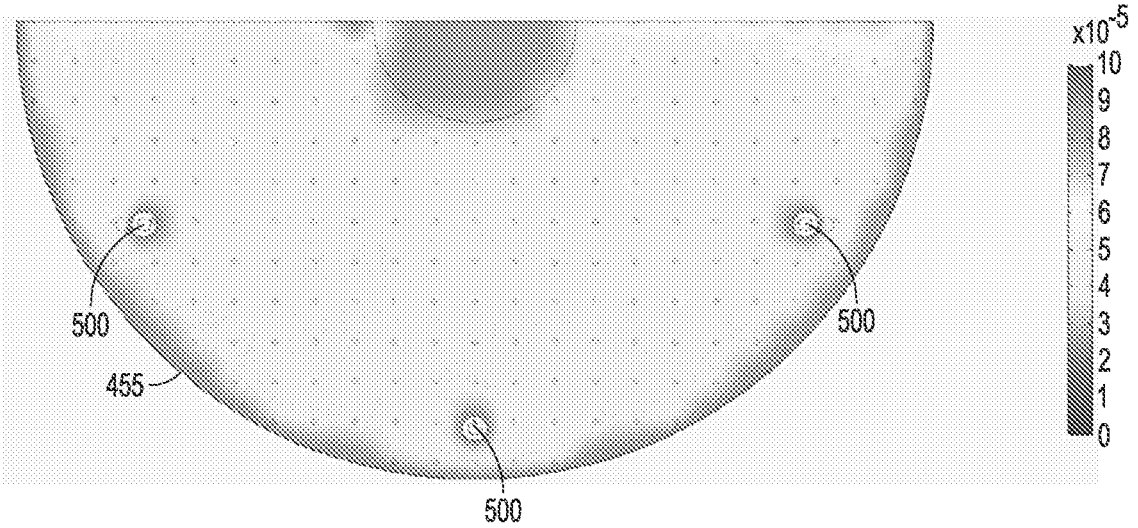
Figure 8D:
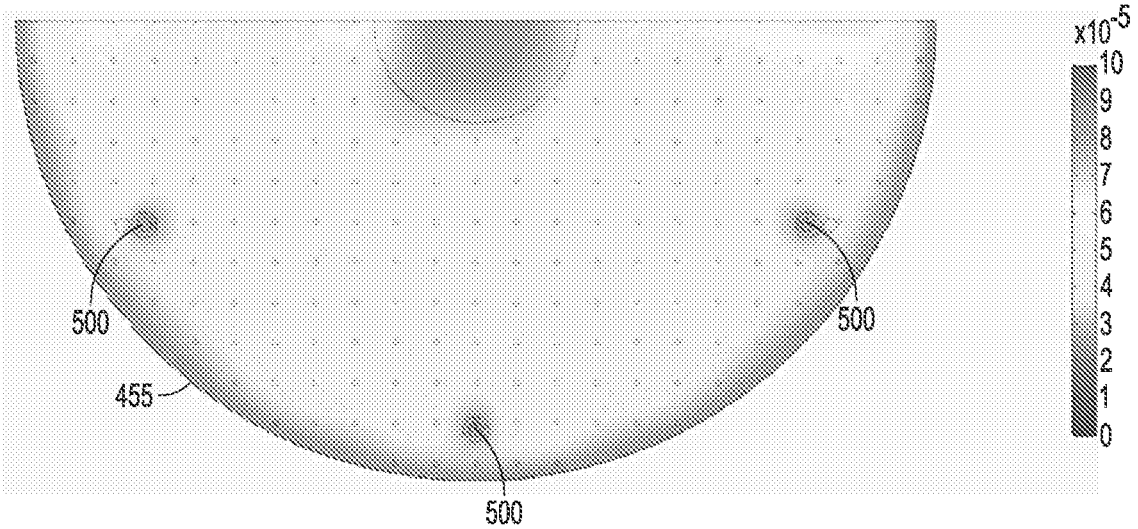

An anode 440 (or 140, or 340, or a layer thereof) may include iridium oxide ($IrO_2$) as an example anode material. Platinum (Pt) and gold (Au) anode materials are also possible. In this regard, FIG. 7 shows graphed results of a linear sweep voltammetry test for sample anodes respectively including Pt, Au, and Ir materials. The test results indicate that anodic currents (mA) were present in the test cell even at negative voltammetry values (region 702). An anodic reaction may comprise oxidation of sulphite to a sulphate material, for example $SO_3^{2-}+2OH^- \rightarrow SO_4^{2-}+2H^+$. The test results also indicate a linear current ramp at 704 for each anode sample until an inflection point 706 indicating further oxidation of sulphite to sulphate. In further testing, current densities as high as 23.4 A for a single anode, or the equivalent of >70 A for a three-layer stacked anode, with no $O_2$ bubble formation, have been achieved.

In some examples, increasing the inert anode area significantly reduces areas of wafer defect. For example, a single 300 mm anode (mesh) layer, for example anode layer 440A, provides approximately 116 $in^2$ of $IrO_2$ surface available for exposure to the electrolyte. This area includes the top, bottom, and side surfaces of a given layer. In some examples of a composite anode 440, the top anode layer 440A exposes approximately 33 $in^2$ to the electrolyte, the bottom anode layer 440C also exposes approximately 33 $in^2$ to the electrolyte, with the remainder of the exposed area being presented by the sides of the layers 440A-C of the composite anode 440. Allowing for areas of overlap when three anode layers 440A, 440B, and 440C of a composite anode 440 are stacked together to form an apertured mesh structure, the ratio of exposed mesh anode area to cathode area is in the range 0.6-0.7 based on a top anode surface area. In some examples, an exposed mesh anode area to cathode area is the range 1.8-21.1 based on a total anode surface area. Other arrangements for increasing or maximizing the surface area of an anode are possible. For example, instead of layers, a highly porous single layer may be used such that the walls of a great multiplicity of pores serve to increase useful area.

FIGS. 8A-8D show charge plate distribution patterns for respective anode-to-plate distances 502 of zero inches (i.e., anode 440 at the plate 455), 0.2 inches, 0.39 inches, and 0.59 inches. The evenness of the charge plate patterns shown in FIGS. 8C-D indicate that flow through an anode 440 positioned above the charge plate 455 can be more evenly distributed at anode-to-plate distances (or standoff pin 500 heights) within a range of approximately 0.39 inches to 0.59 inches. In some examples, an optimum standoff pin height (or anode-to-plate distance 502) is approximately 0.55 inches for maximally enhanced evenness of anode flow.

Figure 9:
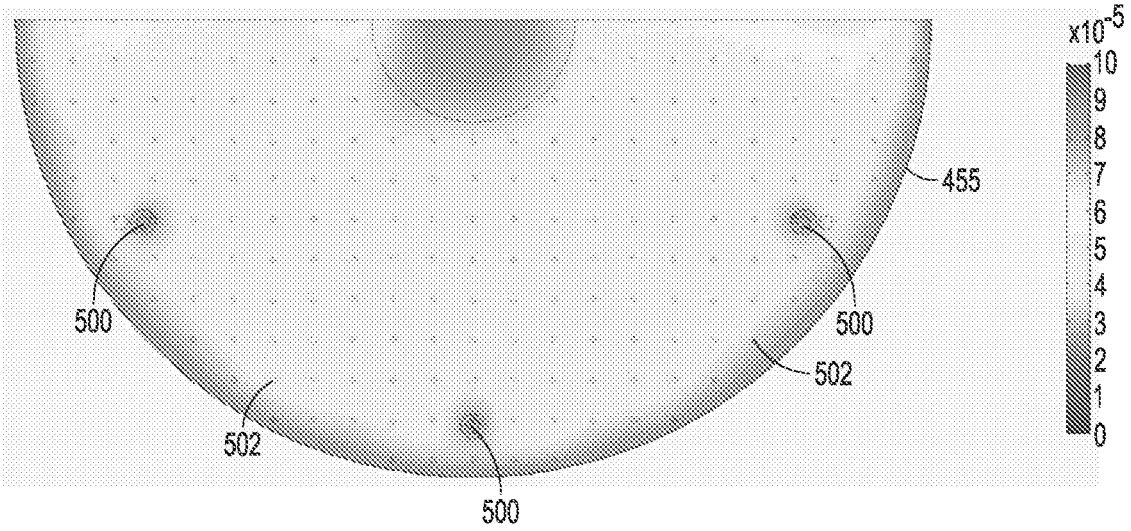
FIG. 9 shows porosity and hole (aperture) spacing values for an example section of charge plate, according to an example embodiment.

FIG. 9 shows porosity and hole (aperture) spacing values for an example section of charge plate 455. In some examples, a hole 902 diameter is 0.040 inches and, in some examples, approximately 348 holes 902 are provided in the charge plate 455. The holes 902 are distributed in an example grid pattern as shown with a 0.60 inch spacing between grid lines. Other hole sizes and distribution patterns are possible. In some examples, the holes 902 may be reduced in number or size to more evenly distribute flow through the charge plate 455. In some examples, the charge plate 455 includes a plurality of holes 902 formed therein, with each hole 902 having a diameter in the range 0.03 to 0.05 inches and being distributed in a grid pattern having a grid spacing in the range 0.4 to 0.7 inches.

Figure 10:
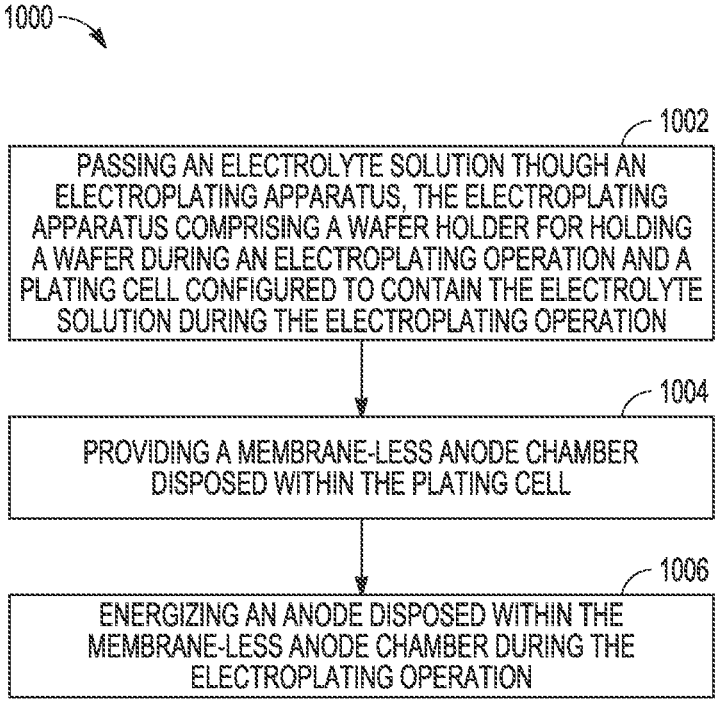
FIG. 10 illustrates example operations in a method, according to an example embodiment.

The present disclosure also includes example methods. In one example, with reference to FIG. 10, an electroplating method 1000 comprises, at 1002, passing an electrolyte solution though an electroplating apparatus, the electroplating apparatus comprising a wafer holder for holding a wafer during an electroplating operation and a plating cell configured to contain the electrolyte solution during the electroplating operation; at 1004, providing a membrane-less anode chamber disposed within the plating cell; and at 1006, energizing an anode disposed within the membrane-less anode chamber during the electroplating operation.

The method 1000 may further comprise providing a charge plate within the membrane-less anode chamber, and in some examples sealing a portion of the charge plate to a wall of the plating cell. The method 1000 may further comprise positioning the anode away from the charge plate by a distance D, wherein the distance D is in the range 0.39 to 0.59 inches. In some examples, positioning the anode away from the charge plate by a distance D includes providing a plurality of standoff pins between the anode and charge plate with each standoff pin having a height corresponding to, or enabling maintenance of, the distance D.

In some examples, providing the charge plate within the membrane-less anode chamber includes providing a charge plate which includes a plurality of holes therein, with each hole having a dimension or diameter in the range 0.03 to 0.05 inches and being distributed in a grid pattern having a grid spacing in the range 0.4 to 0.7 inches.

In some examples, the method 1000 further comprises positioning a flow-shaping plate or CIRP between a wafer held in the wafer holder and the anode during the electroplating operation.

In some examples, the method 1000 further comprises providing the anode in the anode chamber in the form of a composite anode, the composite anode including a plurality of anode layers. The method 1000 may further comprise arranging the layers of the composite anode in displaced form with respect to one another to define open or varied pores of a mesh structure for the anode.

In some examples, a non-transitory machine-readable medium as described further below includes instructions 1124 that, when read by a machine 1100, cause the machine to control operations in methods comprising at least the non-limiting example operations summarized above.

Figure 11:
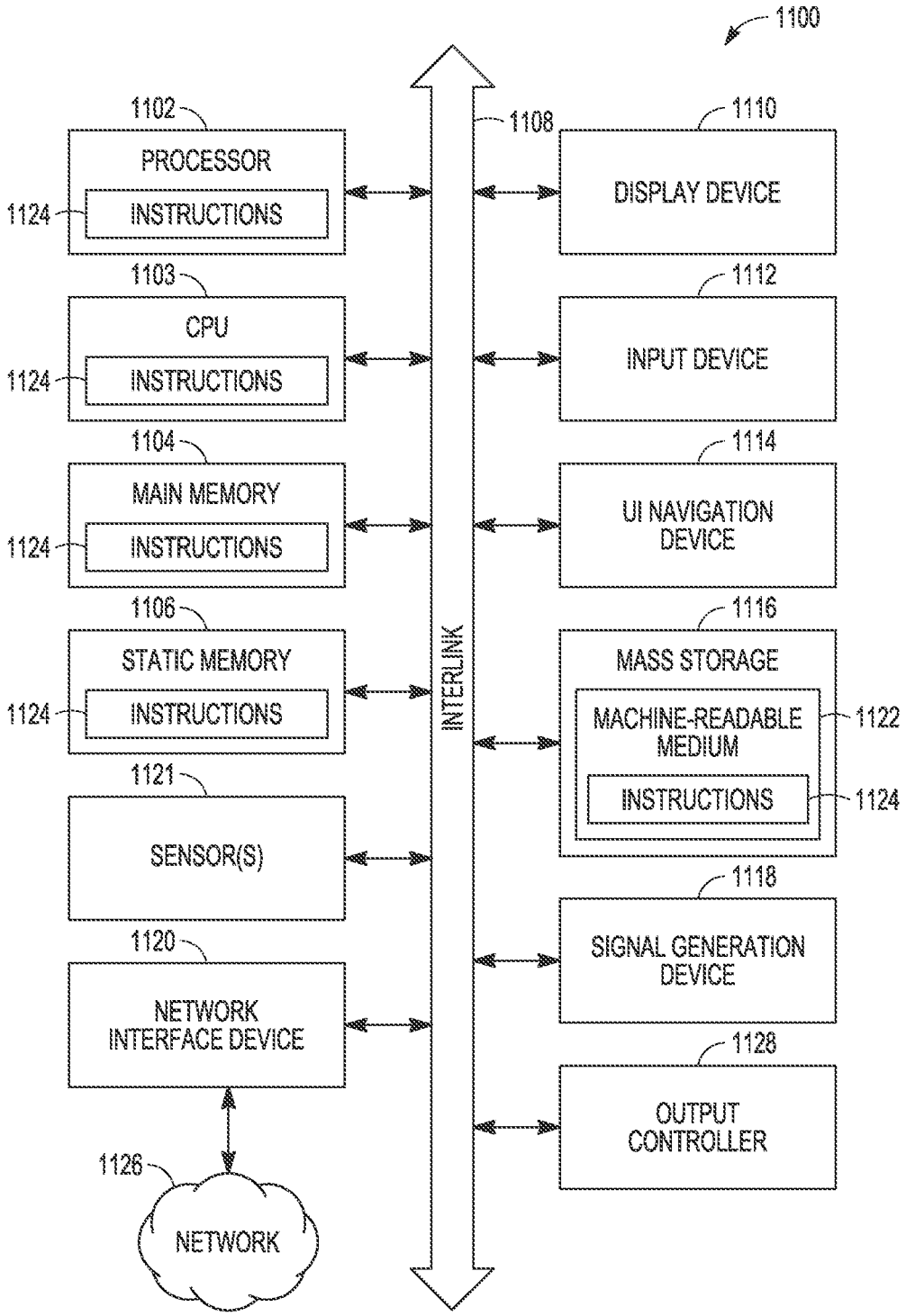
FIG. 11 is a block diagram illustrating an example of a machine upon which one or more example embodiments may be implemented, or by which one or more example embodiments may be controlled.

FIG. 11 is a block diagram illustrating an example of a machine 1500 upon which one or more example process embodiments described herein may be implemented, or by which one or more example process embodiments described herein may be controlled. In alternative embodiments, the machine 1100 may operate as a standalone device or may be connected (e.g., networked) to other machines. In a networked deployment, the machine 1100 may operate in the capacity of a server machine, a client machine, or both in server-client network environments. In an example, the machine 1100 may act as a peer machine in a peer-to-peer (P2P) (or other distributed) network environment. Further, while only a single machine 1100 is illustrated, the term "machine" shall also be taken to include any collection of machines that individually or jointly execute a set (or multiple sets) of instructions to perform any one or more of the methodologies discussed herein, such as via cloud computing, software as a service (SaaS), or other computer cluster configurations.

Examples, as described herein, may include, or may operate by, logic, a number of components or mechanisms. Circuitry is a collection of circuits implemented in tangible entities that include hardware (e.g., simple circuits, gates, logic, etc.). Circuitry membership may be flexible over time and underlying hardware variability. Circuitries include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a computer-readable medium physically modified (e.g., magnetically, electrically, by moveable placement of invariant massed particles, etc.) to encode instructions of the specific operation. In connecting the physical components, the underlying electrical properties of a hardware constituent are changed (for example, from an insulator to a conductor or vice versa). The instructions enable embedded hardware (e.g., the execution units or a loading mechanism) to create members of the circuitry in hardware via the variable connections to carry out portions of the specific operation when in operation. Accordingly, the computer-readable medium is communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry, at a different time.

The machine (e.g., computer system) 1100 may include a hardware processor 1102 (e.g., a central processing unit (CPU), a hardware processor core, or any combination thereof), a graphics processing unit (GPU) 1103, a main memory 1104, and a static memory 1106, some or all of which may communicate with each other via an interlink (e.g., bus) 1108. The machine 1100 may further include a display device 1110, an alphanumeric input device 1112 (e.g., a keyboard), and a user interface (UI) navigation device 1114 (e.g., a mouse). In an example, the display device 1110, alphanumeric input device 1112, and UI navigation device 1114 may be a touch screen display. The machine 1100 may additionally include a mass storage device (e.g., drive unit) 1116, a signal generation device 1118 (e.g., a speaker), a network interface device 1120, and one or more sensors 1121, such as a Global Positioning System (GPS) sensor, compass, accelerometer, or another sensor. The machine 1100 may include an output controller 1128, such as a serial (e.g., universal serial bus (USB)), parallel, or other wired or wireless (e.g., infrared (IR), near field communication (NFC), etc.) connection to communicate with or control one or more peripheral devices (e.g., a printer, card reader, etc.).

The mass storage device 1116 may include a machine-readable medium 1122 on which is stored one or more sets of data structures or instructions 1124 (e.g., software) embodying or utilized by any one or more of the techniques or functions described herein. The instructions 1124 may also reside, completely or at least partially, within the main memory 1104, within the static memory 1106, within the hardware processor 1102, or within the GPU 1103 during execution thereof by the machine 1100. In an example, one or any combination of the hardware processor 1102, the GPU 1103, the main memory 1104, the static memory 1106, or the mass storage device 1116 may constitute machine-readable media 1122.

While the machine-readable medium 1122 is illustrated as a single medium, the term "machine-readable medium" may include a single medium or multiple media (e.g., a centralized or distributed database, and/or associated caches and servers) configured to store the one or more instructions 1124.

The term "machine-readable medium" may include any medium that can store, encode, or carry instructions 1124 for execution by the machine 1100 and that cause the machine 1100 to perform any one or more of the techniques of the present disclosure, or that can store, encode, or carry data structures used by or associated with such instructions 1124. Non-limiting machine-readable medium examples may include solid-state memories, and optical and magnetic media. In an example, a massed machine-readable medium comprises a machine-readable medium 1122 with a plurality of particles having invariant (e.g., rest) mass. Accordingly, massed machine-readable media are not transitory propagating signals. Specific examples of massed machine-readable media may include non-volatile memory, such as semiconductor memory devices (e.g., electrically programmable read-only memory (EPROM), electrically erasable programmable read-only memory (EEPROM)) and flash memory devices; magnetic disks, such as internal hard disks and removable disks; magneto-optical disks; and CD-ROM and DVD-ROM disks. The instructions 1124 may further be transmitted or received over a communications network 1126 using a transmission medium via the network interface device 1120.

Although an embodiment has been described with reference to specific example embodiments, it will be evident that various modifications and changes may be made to these embodiments without departing from the broader scope of the inventive subject matter. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover all adaptations or variations of various embodiments. Combinations of the above embodiments, and other embodiments not specifically described herein, will be apparent to those of skill in the art upon reviewing the above description.

What is claimed is:

1. An electroplating apparatus for electroplating a wafer, the electroplating apparatus comprising:

a wafer holder for holding a wafer during an electroplating operation;

a plating cell configured to contain an electrolyte during the electroplating operation;

an anode chamber disposed within the plating cell;

a charge plate disposed within the anode chamber;

an anode positioned above the charge plate within the anode chamber; and a plurality of standoff pins, wherein the anode is supported above and fixed to the charge plate by the plurality of standoff pins, each standoff pin including a head, a stem, and a foot, wherein a portion of the stem of each standoff pin passes through the anode, wherein each standoff pin passing through the anode includes a rise that includes a thickness dimension of the anode, the rise configured, based on the thickness dimension of the anode, to provide a selected anode-to-charge plate distance, and wherein the foot of each standoff pin is retained in a hole in the charge plate.

2. The electroplating apparatus of claim 1, wherein the anode chamber is a membrane-less anode chamber.

3. The electroplating apparatus of claim 1, further comprising a flow-shaping plate or CIRP positioned between a wafer held in the wafer holder and the anode during the electroplating operation.

4. The electroplating apparatus of claim 1, wherein a portion of the charge plate is sealed to a wall of the plating cell.

5. The electroplating apparatus of claim 1, wherein the rise of the plurality of standoff pins provides the anode-to-charge plate distance in a range of 0.39 to 0.59 inches.

6. The electroplating apparatus of claim 1, wherein the charge plate includes a plurality of holes formed therein, with each hole having a diameter in a range of 0.03 to 0.05 inches and being distributed in a grid pattern having a grid spacing in a range of 0.4 to 0.7 inches.

7. The electroplating apparatus of claim 1, wherein the anode is a composite anode and includes a plurality of anode layers.

8. The electroplating apparatus of claim 7, wherein each layer of the plurality of anode layers is displaced with respect to one another to define open or varied pores of a mesh structure for the anode.

9. The electroplating apparatus of claim 8, wherein at least one of the plurality of the standoff pins passes through the open or varied pores.

* * * * *